US007360506B2

(12) United States Patent
Shellenberger et al.

(10) Patent No.: US 7,360,506 B2
(45) Date of Patent: Apr. 22, 2008

(54) LOW CO WATER HEATER

(75) Inventors: Timothy J. Shellenberger, Tyrone, GA (US); Thomas A. Edds, Jonesborough, TN (US)

(73) Assignee: American Water Heater Company, Atlanta, GA (US)

( * ) Notice: Subject to any disclaimer, the term of this patent is extended or adjusted under 35 U.S.C. 154(b) by 158 days.

(21) Appl. No.: 11/352,637

(22) Filed: Feb. 13, 2006

(65) Prior Publication Data

US 2007/0186872 A1 Aug. 16, 2007

(51) Int. Cl.
*F22B 9/18* (2006.01)

(52) U.S. Cl. ..... 122/13.01; 122/44.2; 122/155.1

(58) Field of Classification Search .... 122/13.01–19.2, 122/44.2, 155.1
See application file for complete search history.

(56) References Cited

U.S. PATENT DOCUMENTS 5,222,476 A * 6/1993 Chmielewski ..... 126/110 C
5,650,127 A 7/1997 Campbell et al.
6,216,687 B1 4/2001 Campbell et al.
6,425,390 B2 7/2002 Campbell et al.
6,479,022 B1 11/2002 Campbell et al.
6,745,724 B2 * 6/2004 Hughes et al. ..... 122/44.2
6,948,454 B2 * 9/2005 Hughes et al. ..... 122/44.2
7,055,465 B1 6/2006 Huang et al.

* cited by examiner

*Primary Examiner*—Gregory A. Wilson
(74) *Attorney, Agent, or Firm*—DLA Piper US LLP

(57) ABSTRACT

A water heater including a water container, a combustion chamber adjacent the water heater, a burner associated with the combustion chamber and arranged to combust fuel to heat water in the water container, a flue having an upper portion and a lower portion operatively connected to the combustion chamber and extending through at least a portion of the water container, and a catalytic converter located in the upper portion of the flue. The water heater may also reduce $NO_x$ and CO emissions generated by a water heater having a radiant burner including activating the burner in response to the temperature of water in the water heater as needed, and substantially removing accumulated foreign matter on the burner by periodically activating the burner irrespective of the water temperature for a selected amount of time.

27 Claims, 2 Drawing Sheets

LOW CO WATER HEATER

TECHNICAL FIELD

This disclosure relates to water heaters, in particular, water heaters that produce low levels of carbon monoxide.

BACKGROUND

The increasing utilization of burners that achieve lower and lower levels of NOx emissions oftentimes does not promote complete combustion of the fuel. This can result in production of higher levels of CO, which is undesirable. Also, new high efficiency or low emission burners utilize small ports and oftentimes act as filters. Over time, such burners may become covered with or subjected to the presence of lint, dirt, oils and the like that are normally found in residential and commercial environments. As the small ports fill with such extraneous material, the levels of CO may increase.

Economic and effective solutions to the presence of CO generated by water heaters have not been entirely successful.

Also, the HVAC, water heater and small appliance industries are continuously updating product designs to meet more stringent combustion emission, energy efficiency, and safety (flammable vapor and lint, dirt and oil resistant) requirements. To achieve these requirements, new burner technologies are being utilized that replace older burner technologies.

The new burner technologies typically utilize significantly reduced port size to achieve desired performance improvements. Unfortunately, these smaller ports may collect foreign materials (such as lint, dirt or oil aerosols) present in the air drawn into the combustion system. As these materials collect on or in the burner ports over time, the performance of the burner may degrade, resulting in higher emissions of carbon monoxide, nitrogen oxides, and overall lower efficiency.

One way of reducing this problem is to utilize a filter on the incoming combustion air. However, such filters add extra cost and often add significant pressure drops that either cannot be overcome or necessitate use of fans or blowers.

Some of the new burner technologies unload a portion of the foreign materials that collect in the ports during burner ignition. The unloading process is due to the large, short duration local pressure and velocity gradients achieved during initial ignition of the combustion gas (typically natural gas or propane). The local pressure and velocity gradients create pressure and friction forces that dislodge some portion of the foreign materials from the burner ports, allowing the burner to return to, or approach, the original "as new" condition.

Additionally, in some of the new burner designs, the flame holder material containing the small ports operates at a high temperature while the burner is operating. When the burner is shut off, the flame holder temperature rapidly drops, approaching ambient temperature. The rapid rise and fall of the flame holder temperature creates thermal movement and stresses in the flame holder, causing the foreign materials to loosen or fall off.

SUMMARY

We provide in one aspect directed to a water heater that includes a water container, a combustion chamber adjacent the water container, a burner associated with the combustion chamber and arranged to combust fuel to heat water in the water container, a flue having an upper portion and a lower portion operatively connected to the combustion chamber and extending through at least a portion of the water container, and a catalytic converter located in the upper portion of the flue.

In another aspect, we provide a water heater including a water container, a combustion chamber adjacent the water container, a burner associated with the combustion chamber and arranged to combust fuel to heat water in the water container, a substantially vertically oriented flue extending through the water container and having an upper portion opening at the top of the water container and a lower portion opening into the combustion chamber, a baffle positioned in the flue, and a catalytic converter connected to the baffle and located in the upper portion of the flue and adapted to convert at least a portion of CO flue gases generated in the combustion chamber to $CO_2$.

In still another aspect, we provide a water heater including a water container, a combustion chamber adjacent the water container, a burner associated with the combustion chamber and arranged to combust fuel to heat water in the water container, a substantially vertically oriented flue extending through the water container and having an upper portion opening at the top of the water container and a lower portion opening into the combustion chamber, a baffle positioned in the flue, and a catalytic converter formed on at least a portion of the baffle and located in the upper portion of the flue and adapted to convert at least a portion of CO flue gases generated in the combustion chamber to $CO_2$.

In yet another aspect, we provide a water heater including a water container, a combustion chamber adjacent the water container, a burner associated with the combustion chamber and arranged to combust fuel to heat water in the water container, a substantially vertically oriented flue extending through the water container and having an upper portion opening at the top of the water container and a lower portion opening into the combustion chamber, a baffle positioned in the flue, and a catalytic converter connected to a removable and elongated baffle comprising a plurality of flow turbulating fins positioned in the flue, wherein the catalytic converter is formed from wound corrugated stainless steel foil coated with a metal catalyst connected to the baffle and located in an upper quartile of the flue such that the metal catalyst facilitates conversion of at least a portion of flue gases generated in the combustion chamber to $CO_2$.

We further provide a water heater including a water container, a combustion chamber adjacent the water container, a burner associated with the combustion chamber, a temperature sensor associated with the water container, a controller that actuates the burner in response to water temperature detected by the temperature sensor and periodically actuates the burner irrespective of water temperature to decrease possible accumulation of foreign materials on the burner.

We still further provide a method of reducing $NO_x$ and CO emissions generated by a water heater having a radiant burner including activating the burner in response to the temperature of water in the water heater as needed, and substantially removing accumulated foreign matter on the burner by periodically activating the burner irrespective of the water temperature for a selected amount of time.

BRIEF DESCRIPTION OF THE DRAWINGS

For the purpose of illustration there is shown in the drawings a form which is presently preferred; it being understood that this disclosure is not limited to the precise arrangements and instrumentalities shown.

DETAILED DESCRIPTION

Figure 1:
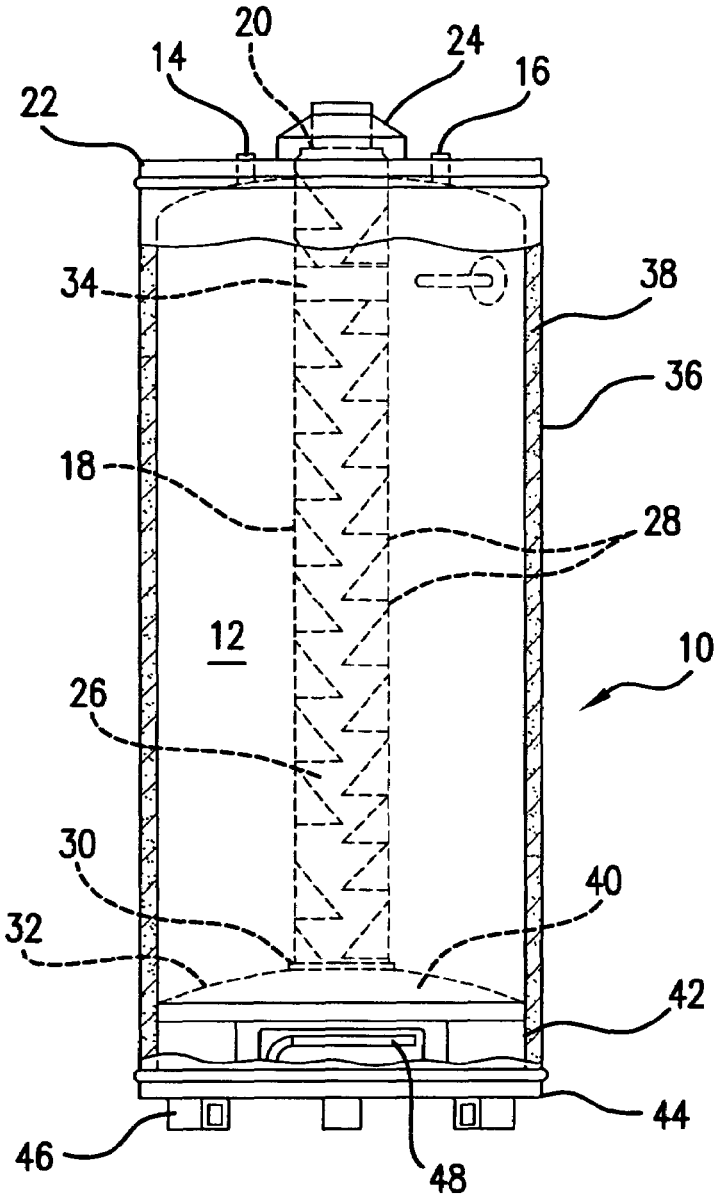
FIG. 1 is a schematic front elevation view of a water heater, taken partially in section, for ease of understanding.

It will be appreciated that the following description is intended to refer to specific structure selected for illustration in the drawings and is not intended to define or limit that structure, other than in the appended claims.

Turning now to the drawings generally and FIG. 1 in particular, one aspect of a water heater is disclosed. A water heater 10 includes a water tank/container 12 having a water inlet 14 and water outlet 16. A substantially vertically oriented flue 18 extends upwardly through the tank and outwardly of the top of the water heater 10 at opening 20. The top of water heater 10 is covered with a top pan 22 and has a draft hood 24 resting on top of it. Draft hood 24 also is aligned with opening 20. Flue 18 contains an elongated baffle 26 having a multiplicity of flow turbulating fins 28. Baffle 26 extends substantially from the upper end of tank 12 to the lower end of tank 12 although other lengths of baffle 26 may be employed. The lower end of tank 12 has an opening 30 formed from tank bottom 32. A catalytic converter 34 is also located within flue 18 and resides in an upper portion of flue 18. Catalytic converter 34 connects to baffle 26 and is sized and shaped to slide into flue 18 and have a substantially similar yet slightly smaller diameter as flue 18. Baffle 26 may be made from any number of materials such as carbon steel, stainless steel, aluminized steel and the like.

Water heater 10 has an outer jacket 36 that surrounds a layer of insulation 38. Insulation 38 is preferably made from any number of foam type of insulations well known in the art and/or fiberglass insulation such as around the lower portion of water heater 10.

A combustion chamber 40 is located below tank 12 and is formed by tank bottom 32, skrit 42 and bottom pan 44. Legs 46 connect to bottom pan 44 and support water heater 10.

A burner 48 is positioned within combustion chamber 40 and above at least one opening (not shown) in bottom pan 44. The opening may be covered with an air inlet/flame trap such as an air inlet/flame type trap of the type disclosed in any of U.S. Pat. Nos. 5,797,355; 6,142,106 and 6,085,699, for example. Similarly, burner 48 can be of any type well known in the art including standard stamped sheet metal steel burners, low NOx burners, radiant heat burners or the like.

Of course, water heater 10 includes other components not described or shown herein that assist in its operation. Those components are well known in the art and need not be discussed herein.

Figure 2:
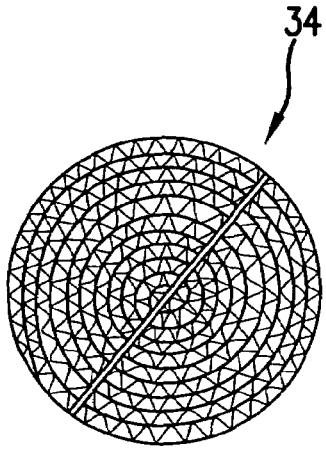
FIG. 2 is a top plan view of a catalytic converter.

FIG. 2 shows one preferred catalytic converter 34 in accordance with aspects of the invention. Catalytic converter 34 is preferably a substantially round disc formed from wound corrugated stainless steel foil. The corrugations preferably form "cells" in a range of between about 10 cells and about 100 cells per square inch. Preferably, the number of cells is at a density of about 40 cells per square inch. Also, the disc is preferably between about ⅛ inches and 4 inches in thickness, most preferably about 1 inches in thickness. It is advantageous to have the catalytic converter facilitate substantially laminar flow of flue gases through flue 18.

The stainless steel of catalytic converter 34 is preferably wash coated with one or more coatings of the oxide type such as aluminum oxide, zirconium oxide and titanium oxide, or the like. A catalyst metal is applied to the wash coating, the catalyst preferably being platinum metal, although other catalyst metals may be employed. Alternately, the catalyst converter can be made of a stainless steel that has a high aluminum content such as aluminum content of between about 4.3 percent and about 6.0 percent. The stainless steel having the high aluminum content is then also coated with a catalyst metal such as platinum or the like.

Catalytic converter 34 preferably converts carbon monoxide (CO) into carbon dioxide ($CO_2$). Catalytic converter 34 preferably converts about 20 percent to about 100 percent of CO in flue gases generated in the combustion chamber to $CO_2$. This results in a very low quantity of CO flowing out of water heater 10 even when high quantities of CO are generated in combustion chamber 40 under the least desirable conditions.

Figure 3:
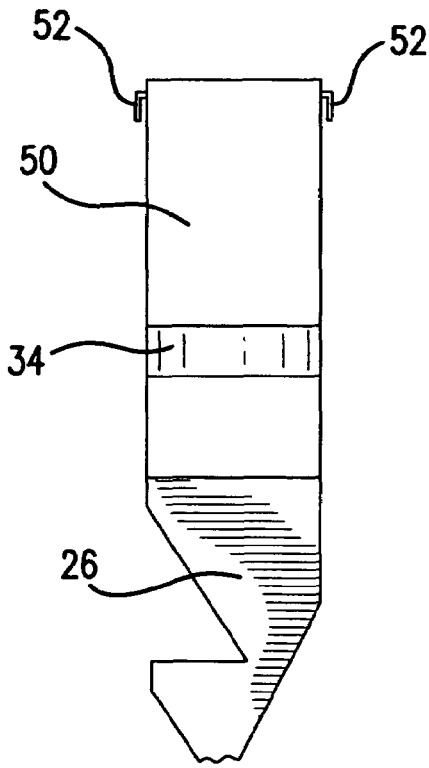
FIG. 3 is a front elevational view of a portion of a baffle and catalytic converter.

As shown in all of FIGS. 1, 2 and 3, catalytic converter 34 is positioned in flue 18 and connects to baffle 26. Catalytic converter 34 may also be connected to flue 18 or suspended in flue 18 by means other than baffle 26 if desired. Catalytic converter 34 is positioned in an upper portion of flue 18, that upper portion meaning the upper half of flue 18, as opposed to the lower half of flue 18. Baffle 26 has a lower portion with a plurality of fins 28 and an upper leader portion 50 as particularly shown in FIG. 3. Leader 50 has a pair of arms 52 that support baffle 26 in flue 18. Arms 52 hang on the edge of opening 20 of flue 18. This allows baffle 26 and catalytic converter 34 to be readily removed from flue 18 if desired.

Figure 4:
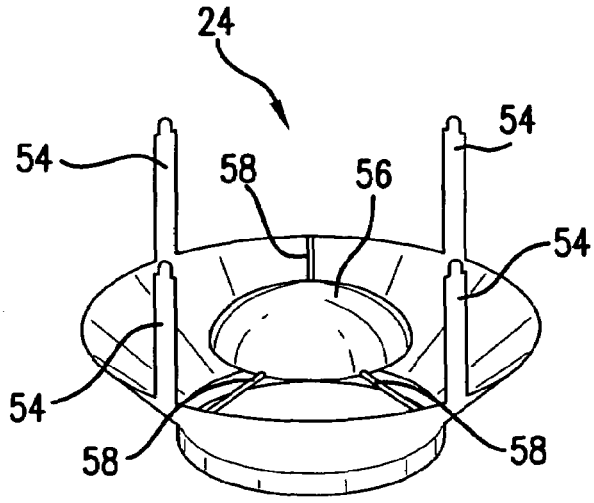
FIG. 4 is an inverted perspective view of a draft hood and debris catcher.
Figure 5:
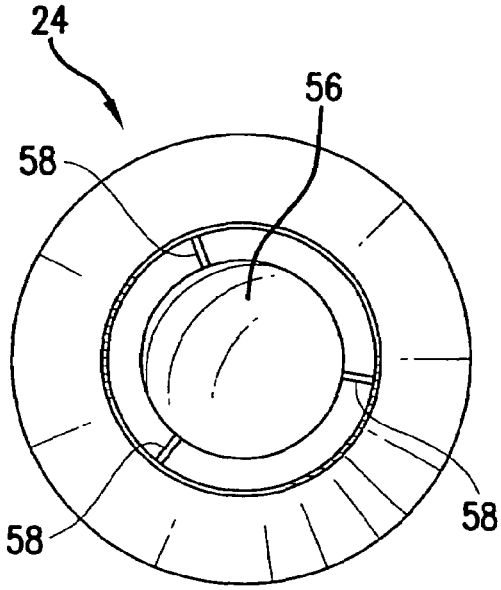
FIG. 5 is a top plan view of the draft hood and debris catcher shown in FIG. 4.

FIGS. 4 and 5 show draft hood 24 removed from water heater 10. Draft hood 24 has a plurality of legs 54 that preferably connect to top pan 22 and are used to center draft hood 24 over opening 20. Draft hood 24 connects to an exhaust line (not shown) in a conventional manner to exhaust flue gases from water heater 10 into a chimney, a wall opening or the like to the outer atmosphere. Draft hood 24 also contains a debris catcher 56 which has a "bowl" or "umbrella" shape such that debris falling downwardly toward flue 18 can be caught and then collect in a lower most portion of debris catcher 56. Debris catcher 56 has a diameter that is preferably substantially the same as the diameter of flue 18 or slightly larger to prevent debris from falling into flue 18 and fouling catalytic 34 or falling down toward and onto burner 48 which, depending on the type of burner, could decrease the performance/efficiency of burner 48. Debris catcher 56 connects to draft hood 24 by a plurality of legs 58. Debris catcher 58 is preferably made from a material that is non-corrosive to both moisture and elevated temperatures.

We discovered that it is advantageous to locate catalytic converter 34 in an upper portion of flue 18, preferably in the upper quartile, more preferably in the upper quintile of flue 18. The construction of catalytic converter 34 should be such that the pressure drop through converter 34 is low enough not to impede the flow of flue gases through flue 18, especially for natural draft water heaters. As previously noted, metallic structures such as stainless steel structures for catalytic converter 34 are more desirable due to the inner wall thicknesses that provide for more open flow areas.

The structure of catalytic converter 34 should have enough active surface area to be able to convert sufficient amounts of CO to $CO_2$. The surface area of the honeycomb structure is determined by the cell count (cells per inch) and cell length and accordingly should be about 40 cells per inch and have a cell length (of thickness of the catalytic converter disc 34) of about ½-1 inches. This structure also facilitates laminar flow of the flue gases flowing through flue 18 to maximize water heater performance.

We also discovered that it is advantageous to have catalytic converter 34 function at an appropriate temperature which is from about 600° F. to about 1100° F. This temperature range was discovered to be in the above-mentioned upper portion of the water heater, preferably the upper quartile.

We also discovered that the catalytic converter can be in the form of a coating applied to baffle 26 and have high effectiveness. Application of a coating of platinum to baffle 26 is especially advantageous. The platinum coating is better adhered to baffle 26 by first wash coating with aluminum oxide, zirconium oxide, titanium oxide, some combination of those elements or the like. The coating provides the additional advantage that standard baffle dies used to fabricate baffle 26 may continue to be used instead of specialized dies.

The catalytic converter coating should have enough active surface area to be able to convert sufficient amounts of CO to $CO_2$. Coverage of baffle 26 depends on the size and shape of baffle 26. This approach has the further advantage that it does not disturb the natural flow of flue gases flowing through flue 18, thereby maximizing water heater efficiency.

One aspect of our water heaters artificially creates extra burner cycles (more than those created by the load on the appliance) to reduce accumulation of foreign materials in the burner ports and increase burner performance. The manner of creating the extra burner cycles includes, but is not limited to, solid state times in electronic controlled applications and mechanical timers in mechanical thermostat type controllers triggered by: pressure, bi-metal thermostats or time delay relays. The exact time of extra burner cycles depends upon the application and burner technology utilized.

We have discovered a water heater that utilizes a wire mesh radiant pre-mix burner that consistently achieves low NOx emissions. Water heaters with inputs less than 75 kbtu must pass stringent test requirements, including a lint, dirt and oil (LDO) test that simulates the accumulation of LDO in the burner over a twenty year period during a nominal 20 hour test. Testing has shown that these burners, if cycled often during the test (every 10-15 minutes), continue to operate close to the "as new" performance levels. If the burner is not cycled regularly, burner performance drops significantly, resulting in high concentrations of carbon monoxide and nitrogen oxides in the flue gas. Gas valve controls can be equipped with electronic controls, powered either by the residential electric supply, or by thermopiles producing mV electrical power from the pilot burner. Such electronic control technologies can be adapted to cycle the burner more often than the ON-OFF cycles created by the actual demand for hot water. Additionally, convenience mechanical thermostat controls can be adapted with timing devices that add the additional burner cycles.

For example, the average burner ON period for a residential water heater is 20 minutes. When equipped with a timing device in the control, the burner can be cycled one or more times within the 20 minute period to ensure the burner ports remain clear of foreign materials. The duration of the burner OFF period can be very short, such that the consumer does not notice a drop in the delivered hot water.

Figure 6:
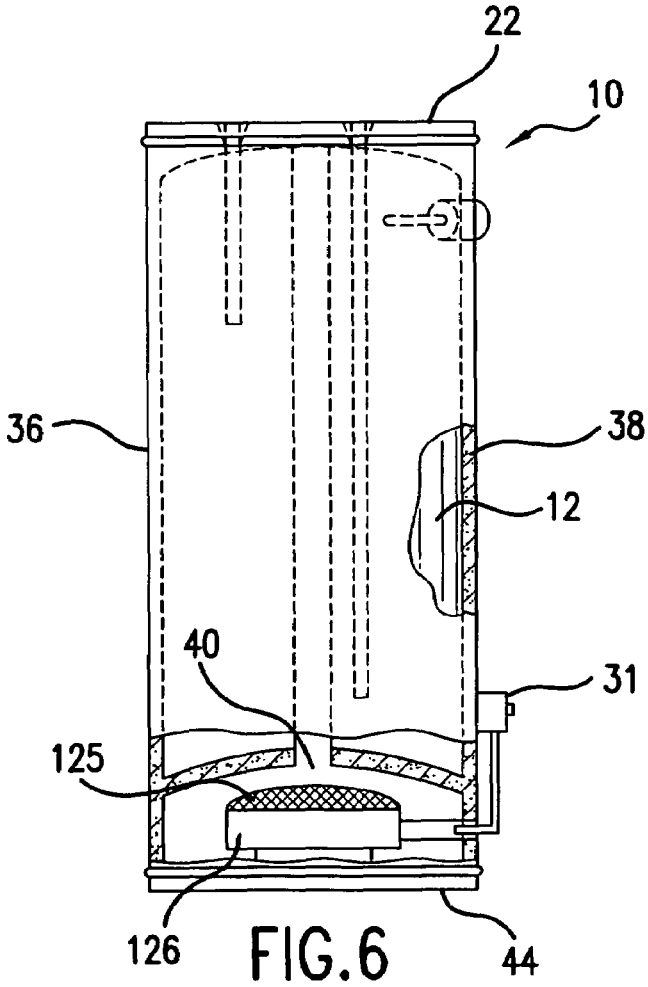
FIG. 6 is a schematic partial sectional view of a water heater having a radiant burner.

FIG. 6 shows a water heater that in some aspects is similar to the water heater shown in FIG. 1. Like elements in FIG. 6 have the same reference number as FIG. 1.

The water heater 10 in FIG. 6 includes a radiant screen gas burner 126. Although FIG. 6 depicts a particular type of radiant screen burner, other radiant burners of this type, including various pre-mix radiant burners, may be used. Burner 126 connects to a venturi 44 that receives fuel from fuel supply line 28 as well as combustion air. Fuel and combustion air mix as they pass through venturi 44, enter burner 126 and ignite on the upper surface of the screen 125 at the top of burner 126.

As shown in FIG. 6, gas control valve 31 contains a controller and the controller actuates burner 126 in response to water temperature detected by a sensor on an as-needed basis. Of course, the controller can be programmed or pre-programmed to actuate the burner at various selected temperatures.

The controller also periodically actuates burner 126, irrespective of the water temperature. This periodic actuation decreases the possible accumulation of foreign materials on the radiant screen of the burner 126. The controller may periodically actuate burner 126 at a selected time interval such as, for example, about every one hour or three hours or four hours, as desired. The actuation period for such periodic actuation can be very short, such as about a minute or two or the like. Also, it is possible that, in the event the burner is activated for longer than the selected time period, the controller deactivates the burner for another selected period of time, followed by reactivating the burner. The selected period of time may be about 10 sec or thereabout, while the another selected time period may be about 30 sec or thereabout.

Alternatively, the controller can actuate burner 126 at a selected time when burner 126 has not been actuated in response to water temperature for a selected period of time. In other words, if burner 126 has not operated for a period of time, such as about one or two or three hours, the controller can actuate burner 126 after the passage of a selected period of time.

Operation of the periodic burner cycles assists in decreasing the potential accumulation of foreign materials on the surface of the burner, thereby keeping the surface of the burner in as close to "as new" condition as possible by avoiding the collection of lints, dirt, oil and the like within the pores or openings in the screen surface. This keeps generation of $NO_x$ and CO as low as possible.

For example, water tank 12 may be made of a number of sizes and may be made from a wide variety of materials such as metals and/or plastics. Foam insulation 38 may similarly be made from any number of high energy efficient foam insulations well known in the art.

The bottom of the water tank 12 may have various shapes, either with lower flanges as shown or as a flat construction. Other modifications may be made, including use of foam insulation between the bottom of tank 12 and bottom pan 44. Also, outer jacket 36 may be made from any number of materials such as rolled metals, preferably steel, or extruded vinyl materials and the like. Also, top pan 22 and bottom pan 44 may be deep-drawn, stamped or the like, or be made from metal, plastic or other suitable materials. Various types of heating elements may be utilized.

The adjustment temperatures for the set point and the conditions necessary for set point adjustment are fully variable and the values used herein are examples for illustration purposes only. One skilled in the art will note that many set point usage combinations are possible without varying from the spirit and scope of the invention.

Although this disclosure has been described in connection with specific forms thereof, it will be appreciated that a wide variety of equivalents may be substituted for the specified elements described herein without departing from the spirit and scope of this disclosure as described in the appended claims.

The invention claimed is:

1. A water heater comprising:

a water container;

a combustion chamber adjacent the water heater;

a burner associated with the combustion chamber and arranged to combust fuel to heat water in the water container;

a flue having an upper portion and a lower portion operatively connected to the combustion chamber and extending through at least a portion of the water container; and a catalytic converter located in the upper portion of the flue at a position within the water container that subjects the catalytic converter to temperatures of about 600°F to about 1100°F.

2. The water heater of claim 1, wherein the catalytic converter converts CO into $CO_2$.

3. The water heater of claim 1, wherein the catalytic converter is a substantially round disc formed from wound corrugated stainless steel foil.

4. The water heater of claim 3, wherein the wound corrugated stainless steel foil has about forty cells per square inch.

5. The water heater of claim 3, wherein the disc is about 1 inches in thickness.

6. The water heater of claim 1, wherein the catalytic converter is stainless steel wash coated with one or more coatings selected from the group consisting of aluminum oxide, zirconium oxide and titanium oxide and a catalyst metal is applied to the wash coating.

7. The water heater of claim 6, wherein the catalyst metal is platinum.

8. The water heater of claim 1, wherein the catalytic converter is sized and shaped such that flue gases passing through the flue are substantially laminar in flow.

9. The water heater of claim 1, wherein the catalytic converter is stainless steel having a high aluminum content coated with a catalyst metal.

10. The water heater of claim 9, wherein the catalyst metal is platinum.

11. The water heater of claim 1, further comprising a baffle extending through at least a portion of the flue.

12. The water heater of claim 11, wherein the baffle is removable.

13. The water heater of claim 12, wherein the catalytic converter is mounted on the baffle.

14. The water heater of claim 11, wherein the baffle is wash coated with one or more of aluminum oxide, zirconium oxide and titanium oxide.

15. The water heater of claim 14, wherein the baffle is coated with platinum.

16. The water heater of claim 1, wherein the catalytic converter is located in an upper quartile of the flue.

17. The water heater of claim 1, wherein the catalytic converter is located in an upper quintile of the flue.

18. The water heater of claim 1, wherein the catalytic converter converts about 20% to about 100% of CO in flue gases generated in the combustion chamber to $CO_2$.

19. The water heater of claim 1, further comprising a draft hood positioned adjacent an opening in the upper portion of the flue.

20. The water heater of claim 19, further comprising a debris catcher positioned over the opening and connected to the draft hood or an upper portion of the water heater adjacent the opening.

21. The water heater of claim 20, wherein the debris catcher is substantially bowl shaped.

22. The water heater of claim 1, wherein the burner is a low NOx burner.

23. A water heater comprising:

a water container;

a combustion chamber adjacent the water container;

a burner associated with the combustion chamber and arranged to combust fuel to heat water in the water container;

a substantially vertically oriented flue extending through the water container and having an upper portion opening at the top of the water container and a lower portion opening into the combustion chamber;

a baffle positioned in the flue; and a catalytic converter connected to the baffle and located in the upper portion of the flue at a position within the water container that subjects the catalytic converter to temperatures of about 600° F. to about 1100° F. to convert at least a portion of CO flue gases generated in the combustion chamber to $CO_2$.

24. A water heater comprising:

a water container;

a combustion chamber adjacent the water container;

a burner associated with the combustion chamber and arranged to combust fuel to heat water in the water container;

a substantially vertically oriented flue extending through the water container and having an upper portion opening at the top of the water container and a lower portion opening into the combustion chamber;

a baffle positioned in the flue; and a catalytic converter coated on at least a portion of the baffle at a position within the water container and located in the upper portion of the flue to subject the catalytic converter to temperatures of about 600° F. to about 1100° F. to convert at least a portion of CO flue gases generated in the combustion chamber to $CO_2$.

25. The water heater of claim 24, wherein the catalytic converter comprises platinum.

26. The water heater of claim 24, wherein the coating contains platinum.

27. A water heater comprising:

a water container;

a combustion chamber adjacent the water container;

a burner associated with the combustion chamber and arranged to combust fuel to heat water in the water container;

a substantially vertically oriented flue extending through the water container and having an upper portion opening at the top of the water container and a lower portion opening into the combustion chamber;

a baffle positioned in the flue; and a catalytic converter connected to a removable and elongated baffle comprising a plurality of heat absorbing fins positioned in the flue wherein the catalytic converter is formed from wound corrugated stainless steel foil coated with a metal catalyst connected to the baffle and located in an upper quartile of the flue at a position within the water container that subjects the catalytic container to temperatures of about 600° F. to about 1100° F. such that the metal catalyst facilitates conversion at least a portion of flue gases generated in the combustion chamber to $CO_2$.

* * * * *